US009829909B2

(12) United States Patent
Yamaguchi et al.

(10) Patent No.: US 9,829,909 B2
(45) Date of Patent: Nov. 28, 2017

(54) STICK DEVICE AND RADIO CONTROL TRANSMITTER USING THE SAME

(71) Applicants: JAPAN REMOTE CONTROL CO., LTD, Osaka-shi, Osaka Pref. (JP); KURIMOTO, LTD., Osaka-shi, Osaka Pref. (JP)

(72) Inventors: Akihiko Yamaguchi, Osaka (JP); Shuichi Akaiwa, Osaka (JP)

(73) Assignee: KURIMOTO, LTD., Osaka Pref. (JP)

( * ) Notice: Subject to any disclaimer, the term of this patent is extended or adjusted under 35 U.S.C. 154(b) by 532 days.

(21) Appl. No.: 14/528,178

(22) Filed: Oct. 30, 2014

(65) Prior Publication Data

US 2016/0124458 A1 May 5, 2016

(51) Int. Cl.

| | |
|---|---|
| ***H01C 10/30*** | (2006.01) |
| ***G05G 5/03*** | (2008.04) |
| ***G05G 1/04*** | (2006.01) |
| ***A63H 30/04*** | (2006.01) |

(52) U.S. Cl.
CPC ..... *G05G 5/03* (2013.01); *A63H 30/04* (2013.01); *G05G 1/04* (2013.01)

(58) Field of Classification Search
USPC ..... 338/118; 345/161; 463/31
See application file for complete search history.

(56) References Cited

U.S. PATENT DOCUMENTS

| | | | | |
|---|---|---|---|---|
| 6,300,936 | B1 * | 10/2001 | Braun | G05B 19/00 345/156 |
| 7,250,844 | B2 * | 7/2007 | Arai | A63H 30/04 338/118 |
| 2003/0137394 | A1 * | 7/2003 | Romero Herrera | G05G 9/047 338/32 H |
| 2012/0112894 | A1 | 5/2012 | Yang et al. | |
| 2012/0302293 | A1 * | 11/2012 | Johnson | B06B 1/045 455/567 |

FOREIGN PATENT DOCUMENTS

| | | | |
|---|---|---|---|
| JP | H06-339582 | A | 12/1994 |
| JP | 2004-538520 | A | 12/2004 |
| JP | 2006-102010 | A | 4/2006 |
| WO | 03014907 | A1 | 2/2003 |

* cited by examiner

*Primary Examiner* — Masud Ahmed
(74) *Attorney, Agent, or Firm* — McGlew and Tuttle, P.C.

(57) ABSTRACT

Inside a stick base, a variable resistor and a magnet brake are attached to a turnable first bridge. An A/D converter adapted to convert an analog value corresponding to a turning angle, which is obtained from the variable resistor, to a digital value, and a controller adapted to drive the magnet brake when a signal from the A/D converter is given and coincides with a predetermined value are provided. On the basis of data retained in a memory, current is applied to a coil of the magnet brake. Doing so makes it possible to electrically change operational feeling when turning a stick.

6 Claims, 8 Drawing Sheets

STICK DEVICE AND RADIO CONTROL TRANSMITTER USING THE SAME

BACKGROUND OF THE INVENTION

1. Field of the Invention

The present invention relates to a radio control transmitter and a stick device, and in particular, to a stick device characterized by setting click feeling and resistance of a stick lever, and a radio control transmitter using the stick device.

2. Discussion of the Related Art

A conventional radio control transmitter for remotely controlling a model such as a model helicopter or a model plane is arranged with typically two stick levers that function as manipulators, and also other levers, and switches that function as auxiliary manipulators. In the case of controlling a model such as a model helicopter or a model plane as a controlled object, as the stick levers, a stick adapted to perform engine control and aileron control, and a stick adapted to perform rudder control and elevator control are used, and these sticks are typically arranged left and right. For example, Japanese unexamined Patent publication No. H6-339582 discloses such a stick unit.

Stick levers include: one having an automatic recovery function that when an operator releases the stick lever depending on the type of a controlled object or a control site, automatically recovers to a neutral position; and one having a retaining function that when an operator releases the stick lever at an arbitrary position, can retain the position thereof without change. A radio control transmitter requires the retaining function that retains an operated position when performing a stick operation for power control of an engine or motor for a model. For this purpose, a retaining mechanism is provided, and the retaining mechanism is adapted to fix a position of a stick lever even when an operator releases the stick lever, and retain a corresponding control amount.

Meanwhile, in order to realize a retaining mechanism for a stick lever, an arcuate member interlocking with an operation of the stick lever is provided, on the surface of which, grooves are provided, and an elastic plate to be pressure-contacted by the surface is provided. Depending on a controlled object, a different elastic plate is used. For example, a stick lever used for a model plane is adapted to obtain click feeling at regular intervals by providing one protrusion at the center of an elastic plate of an arcuate member, and making the protrusion engage with a grooves of the arcuate member to discontinuously retain the stick lever at regular operating angle intervals of the stick lever. On the other hand, in the case of a model helicopter, a stick lever is adapted to be able to retain an operated position steplessly by forming an elastic plate as a flat plate having no protrusion, and pressing the elastic plate against an arcuate member.

SUMMARY OF THE INVENTION

Accordingly, in the case of switching a radio control transmitter between a model plane use and a model helicopter use after purchasing the radio control transmitter, it is necessary to replace an elastic plate. When replacing the elastic plate, it is necessary to open a back cover of the transmitter, remove the already attached elastic plate to replace it by another elastic plate, and further adjust spring force so as to meet preferences. For this reason, such replacing work takes time and effort.

In addition, there is a problem that because of the absence of an elastic plate appropriate for a model glider, an elastic plate for a model plane is used without change, which is not an appropriate one.

The present invention intends to provide a radio control stick device adapted to be able to easily change click feeling and resistance to user's preferred ones, and a radio control transmitter using the stick device.

A stick device of the present invention comprises: a stick base; a bridge that is turnably held by said stick base; a stick that is attached to said bridge, and turns the bridge; a variable resistor that is attached to a rotary shaft of said bridge, and applied with voltage at one end to output a voltage corresponding to a turning angle; a magnet brake that is attached to the rotary shaft of said bridge, and changes a rotational resistance with magneto-rheological fluid of which viscosity is changed by applied current to a coil; an A/D converter that converts an analog value obtained from said variable resistor according to a turning angle to a digital value; and a controller that is given a digital signal from said A/D converter, and on a basis of said digital signal, controls the applied current to said magnet brake.

In the stick device, said magnet brake may include: a case; a rotary disk that is connected to the rotary shaft of said bridge in said case; the coil that is contained in said case; and the magneto-rheological fluid that is enclosed around said rotary disk in said case.

Said controller may have a memory that retains an A/D converted value, and performs control so as to compare the digital signal obtained from said A/D converter with the A/D converted value retained in said memory, and when the digital signal and the A/D converted value coincide with each other, increase the applied current to said magnet brake.

A radio control transmitter of the present invention includes said stick device.

The present invention can freely select and set operational feeling of a stick of the radio control transmitter. Accordingly, even in the case of a stick requiring click feeling or a stick not requiring click feeling, or even at any angle, arbitrary operational feeling can be obtained. Even when changing click feeling or resistance, complicated work such as opening a back cover of the transmitter or the like to change an elastic plate is not required. A user can enjoy an effect that makes it possible to easily and freely set an angle at which the user can obtain click feeling, the intensity of the click feeling, and operational resistance.

DESCRIPTION OF THE PREFERRED EMBODIMENTS

Figure 1:
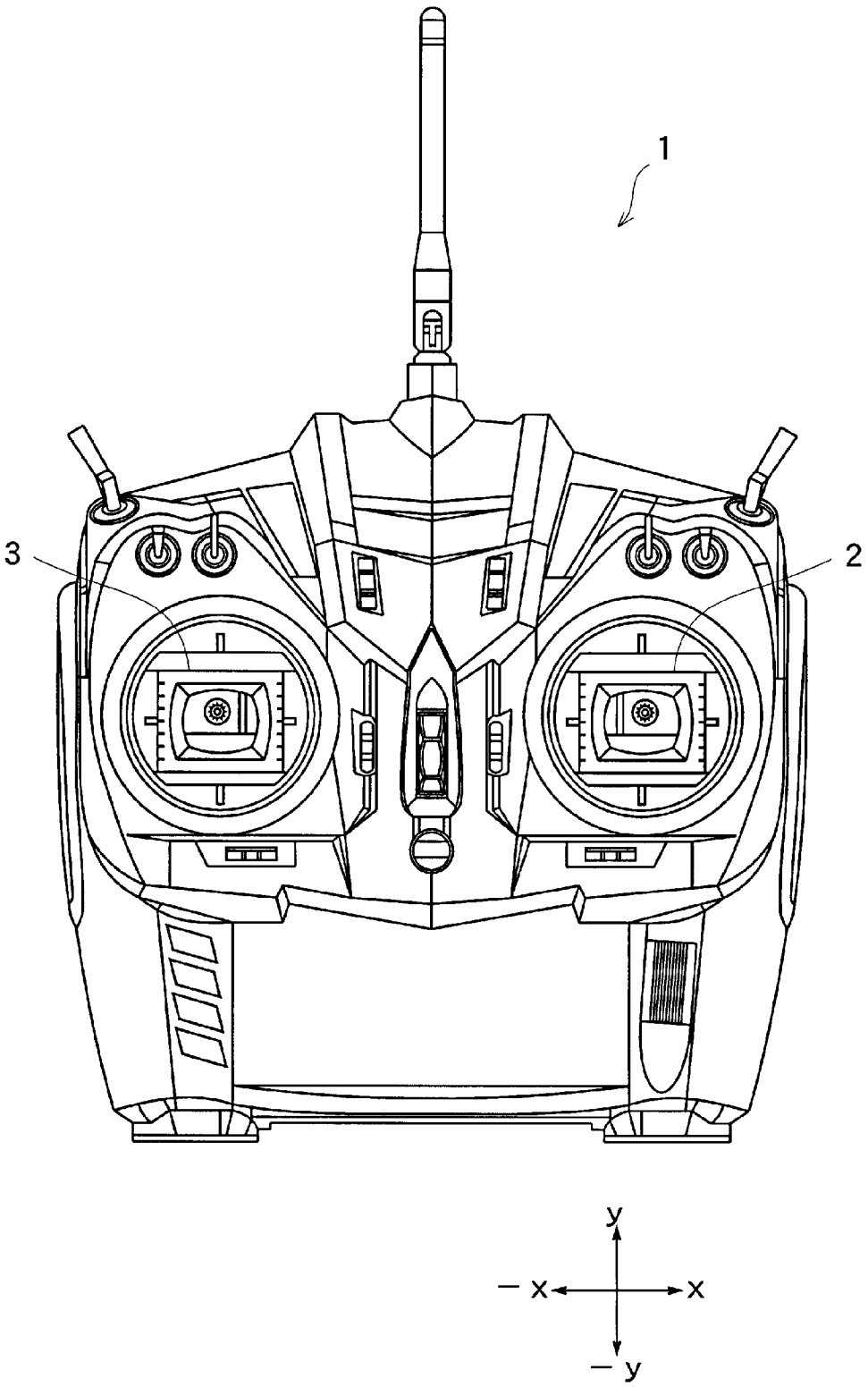
FIG. 1 is a front view of a radio control transmitter according to an embodiment of the present invention.
Figure 2:
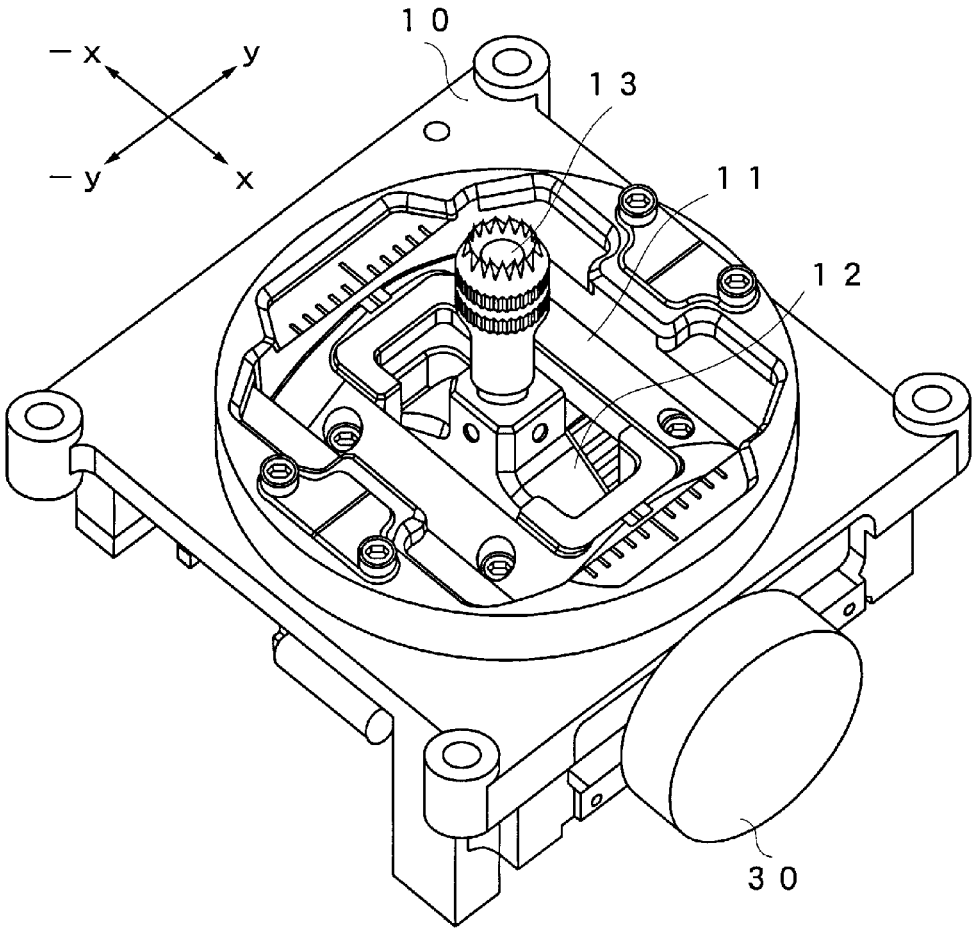
FIG. 2 is a perspective view of a stick unit of a stick device according to the embodiment of the present invention.

Next, described are a radio control transmitter according to an embodiment of the present invention, and a stick unit used for the transmitter. FIG. 1 is a front view of the radio control transmitter of the present embodiment, and FIG. 2 is a perspective view of the stick unit of the radio control transmitter. As illustrated in these views, on the right side of the radio control transmitter 1 in the front view, a stick unit 2 for engine or motor control and for aileron control is provided, and on the left side, a stick unit 3 for elevator and rudder control is provided. The stick units 2 and 3 have substantially the same structure; however, described in detail below is the stick unit 2, which characterizes the present application. In the stick unit 2, as illustrated in FIG. 2, a stick base 10, which is substantially square-shaped when viewed from above, is attached with a first bridge 11 and a second bridge 12 turnably in a ±y-axis direction and a ±x-axis direction, respectively. A turning angle is controlled by operating a stick 13. In FIG. 2, an operation in the ±y-axis direction is defined as a stick operational direction for engine control, and an operation in the ±x-axis direction is defined as a stick operational direction for aileron control.

Figure 3:
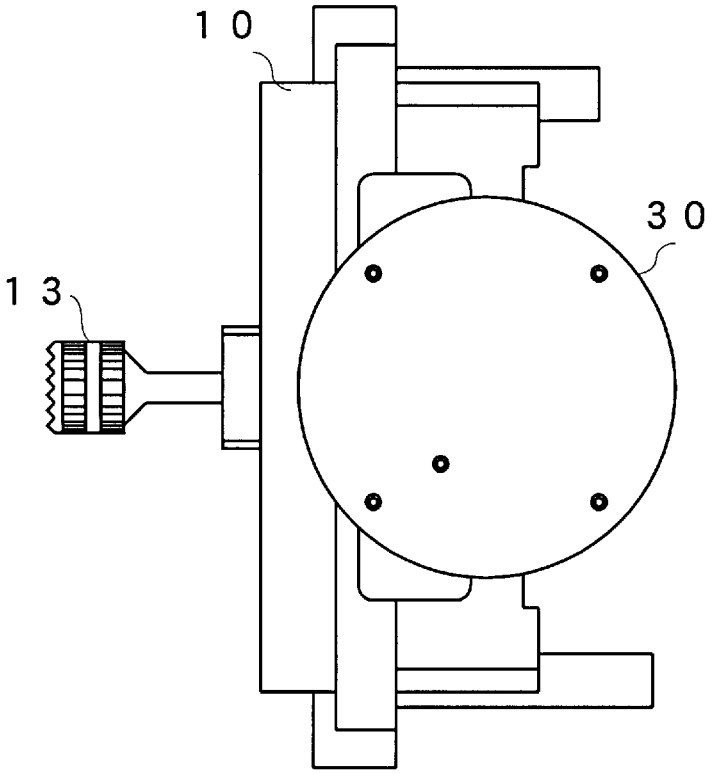
FIG. 3 is a right lateral view of the stick unit according to the present embodiment.
Figure 4:
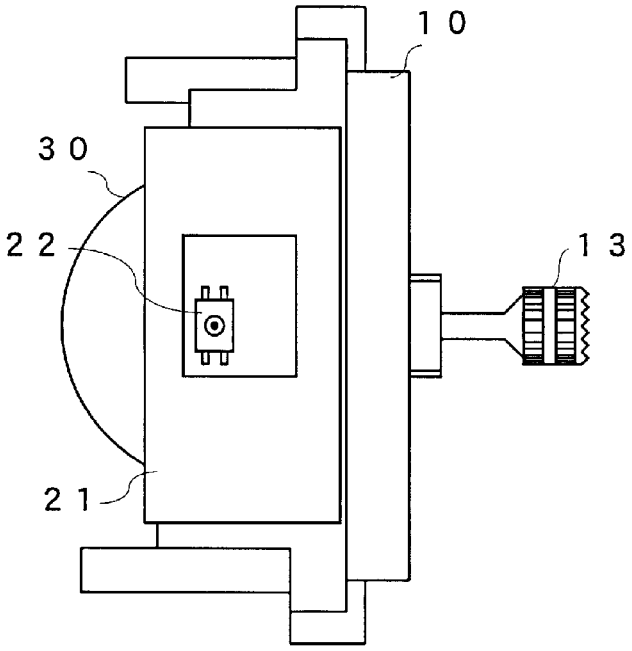
FIG. 4 is a left lateral view of the stick unit according to the present embodiment.

FIG. 3 is a right lateral view of the stick base 10, and FIG. 4 is a left lateral view of the stick base 10. As illustrated in FIG. 4, on the left lateral surface, a board 21 is attached, and a variable resistor 22 interlocking with a rotary shaft of the first bridge 11 is mounted on the board 21. From the variable resistor 22, a resistance value corresponding to a turning angle is obtained. Also, as illustrated in FIG. 3, on the right lateral surface, a thin columnar-shaped magnet brake 30 is provided. The magnet brake 30 is attached in order to electrically change a rotational resistance at the time of turning the first bridge 11 in the y-axis direction to thereby set feeling (hereinafter referred to as click feeling) at the time of operating the stick 13 in the y-axis direction.

Figure 5:
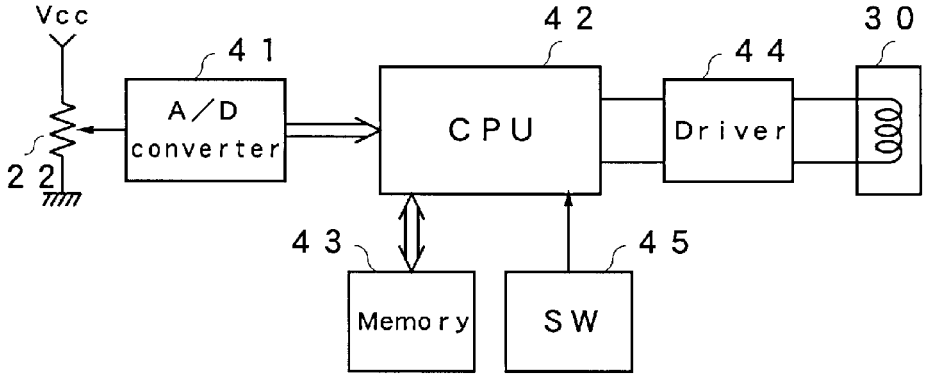
FIG. 5 is a block diagram illustrating a configuration of the stick device according to the present embodiment.

Next, described is a block diagram of a stick device that feeds back an output from the variable resistor 22 to the magnet brake 30. FIG. 5 is the block diagram illustrating a configuration from the variable resistor 22 to the magnet brake 30. As illustrated in the diagram, a constant voltage Vcc of 3 V, for example from a voltage source to is applied the variable resistor 22, and an output from the variable resistor 22 is given from an intermediate point of the variable resister 22. At the central position in a stick operation range, the variable resistor 22 is also set at the midpoint position, and a voltage of 1.5 V is outputted. Also, when turning the first bridge 11 to the minus end in the y-axis direction, the lowest voltage is outputted, whereas when turning the first bridge 11 to the plus end, the highest voltage is outputted. An A/D converter 41 is one that converts the output to a digital value, and gives a digital output of, for example, 11 bits to a CPU 42 at predetermined timing. The CPU 42 compares the A/D converted value with data in the memory according to a program preliminarily set in a memory 43, and controls timing at which current is applied to the magnet brake 30, and a value of the current. The output from the CPU 42 is given to a coil of the magnet brake 30 through a driver 44. A switch 45 is a push button switch that is operated when setting A/D converted values respectively corresponding to predetermined turning angles of the first bridge 11 in the memory 43.

Note that the CPU 42, memory 43, and driver 44 constitute a controller that controls the current to be applied to the magnet brake 30 on the basis of predetermined A/D converted values retained in the memory 43.

Figure 6:
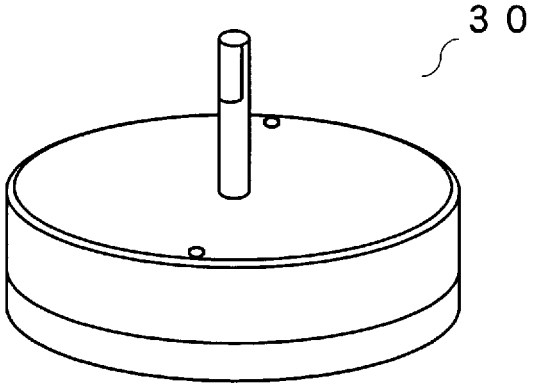
FIG. 6 is a perspective view of a magnet brake used in the present embodiment.
Figure 7:
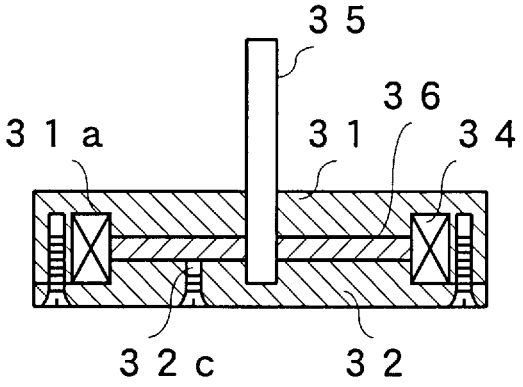
FIG. 7 is a cross-sectional view of the magnet brake used in the present embodiment.
Figure 8:
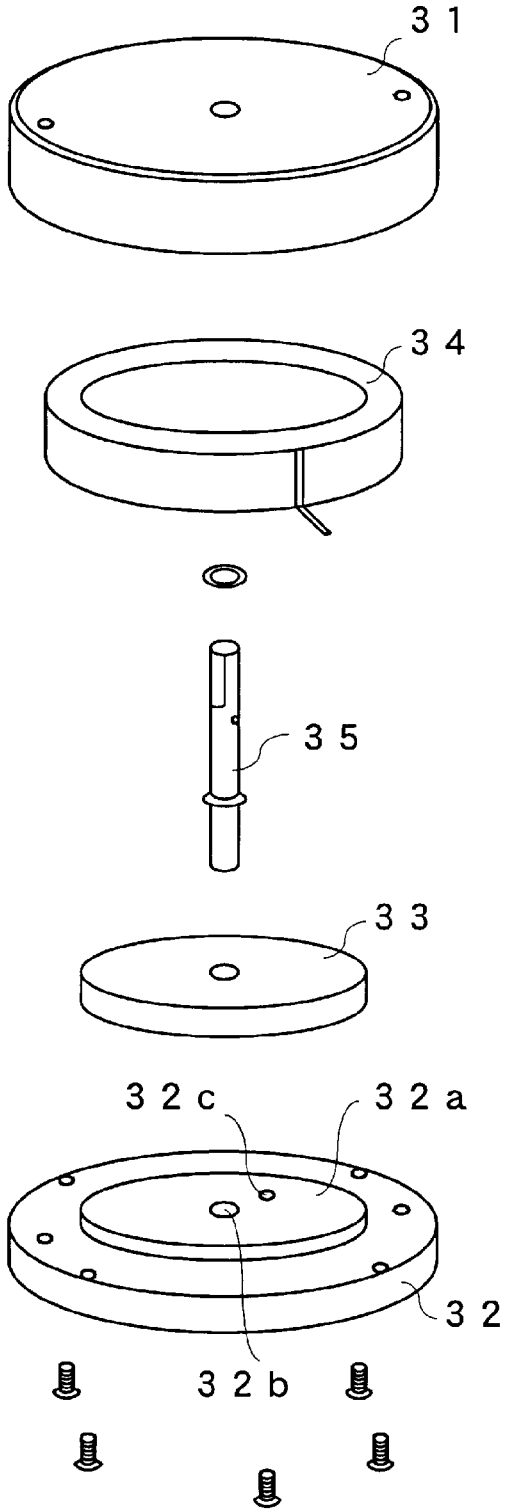
FIG. 8 is an assembly configuration view of the magnet brake according to the present embodiment.

Next, described is the magnet brake 30 attached in the stick device. The magnet brake 30 is, as illustrated in a perspective view of FIG. 6, a cross-sectional view of FIG. 7, and an assembly configuration view of FIG. 8, a thin columnar member. The magnet brake 30 includes an upper case 31 and a lower case 32, a disk 33 and a coil 34. In the center of the lower case 32, a thin disk-like protrusion 32*a* is provided on the inner side, and at the center of the protrusion 32*a*, a circular depression 32*b* adapted to hold a rotary shaft 35 is formed. Also, in a part of the protrusion 32*a* of the lower case 32, a through-hole 32*c* penetrating to the rear surface is provided. Further, in the inner surface of the upper case 31, an annular depression 31*a* is formed. The depression 31*a* holds the annular coil 34 provided on the disk 33. Still further, between the disk 33 and the upper case 31, and between the disk 33 and the lower case 32, a narrow gap of, for example, approximately 80 μm is formed, and in the gap, magneto-rheological fluid 36 is enclosed. As illustrated in FIG. 8, the rotary shaft 35 is inserted into the depression 32*b* of the lower case 32, then made to penetrate through an opening in the center of the disk 33 and connected to the disk 33, and made to protrude from an upper opening of the upper case 32. In doing so, an extra amount of enclosed magneto-rheological fluid 36 is ejected from the through-hole 32*c* of the lower case 32, and then sealing is performed with a screw.

The magneto-rheological fluid 36 used here is, for example, as disclosed in Japanese Unexamined Patent Publication JP-A2012-202429, liquid prepared by dispersing nanosized magnetic particles in a dispersion medium. The magnetic particles are magnetizable metallic particles (metallic nanoparticles) such as iron, cobalt, or nickel particles, or alloy particles such as permalloy particles, and an average particle size thereof is desirably 20 to 500 nm. As the dispersion medium, for example, hydrophobic silicone oil is used. Note that applying/removing a magnetic field to/from the magneto-rheological fluid 36 can rapidly change the viscosity of the magneto-rheological fluid 36.

When not applying current to the annular coil 34 of the magnet brake 30 used here, a magnetic field is not generated, thus not producing viscosity, and therefore the disk 33 can freely rotate with little resistance. On the other hand, when applying current to the annular coil 34, the viscosity of the magneto-rheological fluid 36 increases, and thereby rotational resistance of the disk 33 can be rapidly increased. Accordingly, connecting the magnet brake 30 to a rotary shaft of the first bridge 11, and controlling the applied current to the coil of the magnet brake 30 can arbitrarily change feeling at the time of operating the stick 13 in the ±y-axis direction.

Figure 9A:
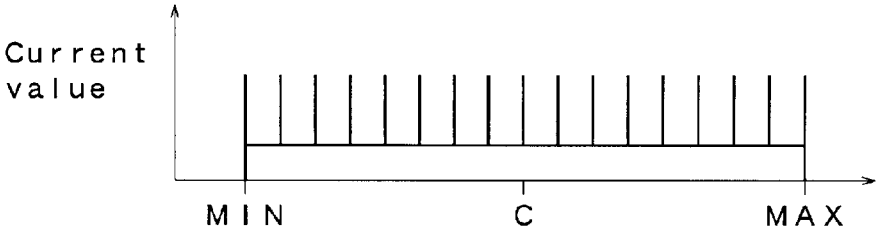
FIGS. 9A to 9D are graphs illustrating current changes corresponding to an operating angle according to the present embodiment.

Next, described is an example of a resistance value that is set corresponding to an angle of the stick. As described above, engine control of a radio-controlled model plane requires an operation having click feeling at regular intervals. Depending on an operating angle of the stick in the y-axis direction, a resistance value of the variable resistor 22 interlocking with the rotary shaft, and an outputted voltage change, and A/D converting the voltage results in obtaining a digital signal from the A/D converter 41. Accordingly, a turning angle can be obtained as a digital signal from the A/D converter 41. Also, increasing a value of the current applied to the coil 34 of the magnet brake 30 through the driver 44 at regular angle intervals increases the rotational resistance during operation at the timing of increasing the current. Accordingly, as illustrated in FIG. 9A, control is performed so as to increase a current value every time an A/D converted value is obtained at substantially regular intervals within the range where the A/D converted value from the A/D converter 41 changes from the minimum value (MIN) in the −y-axis direction to the maximum value (MAX) in the +y-axis direction through the central position (C). For example, given that a voltage and current applied to the magnet brake 30 are respectively 2.5 V and 230 mA, the strength of a generated magnetic field is approximately 500 mT, which makes it possible to increase the rotational resistance of the first bridge 11, and therefore click feeling can be obtained. In doing so, when operating the stick from one end to the other end, the resistance value increases intermittently at regular angle intervals, and therefore click feeling equivalent to conventional one can be obtained.

Figure 9B:
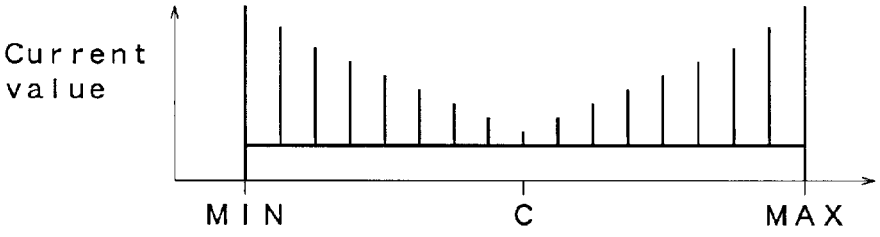

The rotational resistance at the time of obtaining click feeling is not required to be constantly fixed. For example, as illustrated in FIG. 9B, the current value can also be controlled so as to increase toward the minimum (MIN), take the smallest value at the center (C), and increase again toward the maximum (MAX).

Figure 9C:
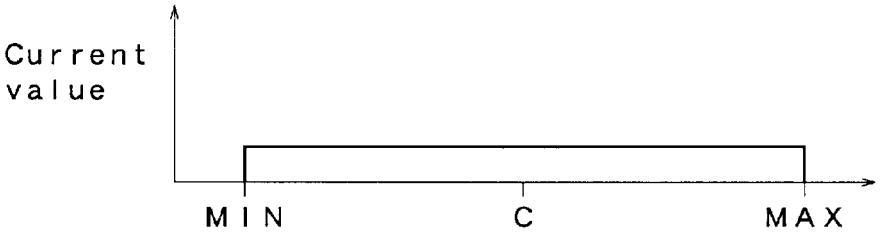

Further, in order to obtain stepless operational feeling used for a conventional radio control transmitter for a model helicopter, as illustrated in FIG. 9C, regardless of an operating angle in the y-axis direction, a fixed level of current is constantly applied. In doing so, an operation can be performed while obtaining a constantly fixed rotational resistance. In addition, changing the current value can change the resistance of a stick operation.

Figure 9D:
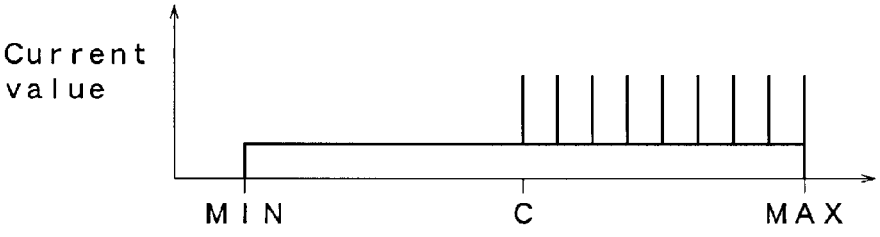

Still further, depending on a controlled object, as illustrated in FIG. 9D, the present invention can also be configured to make settings to obtain click feeling by only operations toward positions on the upper side of an arbitrary position of the stick, and on the lower side of the arbitrary position, prevent the click feeling. A position to switch the click feeling may be the central position (C), or another position.

Both of intervals at which click feeling is obtained and a resistance value above which the click feeling be obtained may also be freely selected by setting them in the memory 43.

Figure 10A:
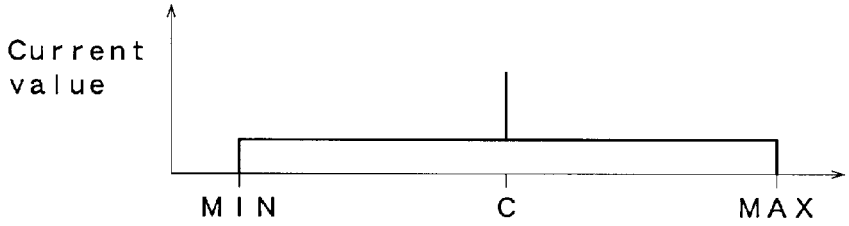
FIGS. 10A and 10B are graphs illustrating current changes corresponding to an operating angle according to the present embodiment.

Also, as illustrated in FIG. 10A, increasing a value of applied current only at the central position in the operation range in the y-axis direction can result in obtaining a stick that obtains click feeling only at the central position.

Figure 10B:
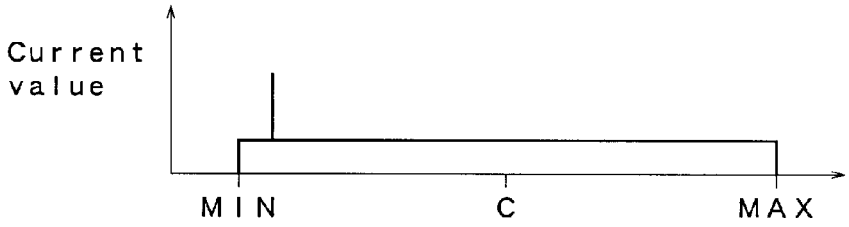

Further, as illustrated in FIG. 10B, the present invention can also make settings to obtain click feeling at a predetermined turning angle. For example, using the switch 45 of the transmitter illustrated in FIG. 4 to press down the switch 45 at a fixed turning angle may store an A/D converted value at the angle in the memory 43. Doing so makes it possible to obtain click feeling arising from large rotational resistance to the stick at the angle.

Such control can be used to obtain click feeling, for example, at the lowest engine power level used during normal flight. Doing so makes it possible to prompt an operator to constantly perform an operation while outputting power equal to or more than the lowest level during normal flight, thus being able to reduce the possibility of occurrence of a situation where an engine is shut down.

On the other hand, in the case of controlling a model motor glider or the like, in many cases, according to an operating angle of the stick 13 in the y-axis direction, a motor is controlled or a flap and spoiler are controlled. Accordingly, by configuring the stick device so as to be able to obtain click feeling at an arbitrary operational position of the motor control stick as described, an operator can recognize that the operator is performing motor control, or flap or spoiler control. Such click feeling can be freely changed by changing data that is written in the memory when a user makes settings.

The above-described current control in FIGS. 9A to 10B is configured to constantly apply fixed current, and when reaching a predetermined value, increase a current value to be applied; however, constantly applying the fixed current is not necessarily required.

Figure 11A:
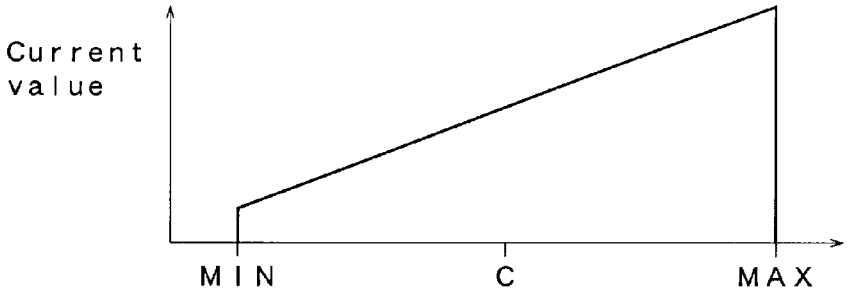
FIGS. 11A and 11B are graphs illustrating current changes corresponding to an operating angle according to the present embodiment.
Figure 11B:
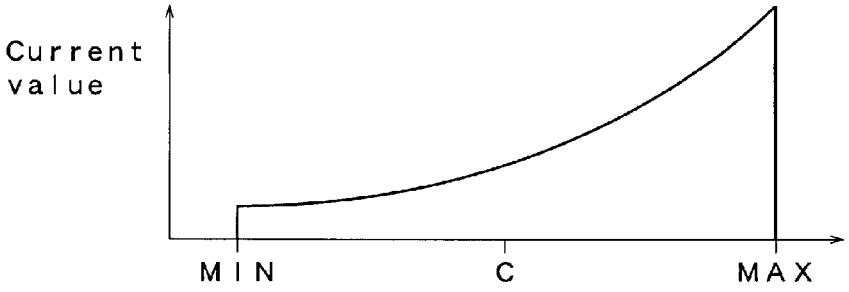

FIG. 11A is a diagram illustrating stick resistance that is made to linearly increase from the minimum value toward the maximum value in the stick operation range. Also, FIG. 11B is a diagram illustrating stick resistance that is similarly made to exponentially increase from the minimum value toward the maximum value in the stick operation range. As described, the resistance may be successively changed according to the operating angle of the stick. Further, in FIGS. 11A and 11B, the resistance is increased corresponding to the operating angle of the stick; however, the resistance may be decreased corresponding to the operating angle.

Note that in this embodiment, described is the stick unit having the first and second bridges that turn in the x-axis direction and in the y-axis direction; however, needless to say, the present invention is also applicable to a stick that can turn only in the y-axis direction.

Also, this embodiment is adapted to obtain click feeling by connecting the magnet brake for an operating direction of the stick for engine or motor control; however, the present invention may also be adapted to connect the magnet brake for another operating direction, for example, for aileron control, or elevator or rudder control. Doing so makes it possible to configure the stick device and radio control transmitter so as to obtain click feeling in any operating direction, or so as to change a resistance value with an external signal.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A stick device comprising:

a stick base;

a bridge that is turnably held by said stick base;

a stick that is attached to said bridge, and turns the bridge;

a variable resistor that is attached to a rotary shaft of said bridge, and applied with voltage at one end to output a voltage corresponding to a turning angle;

a magnet brake that is attached to the rotary shaft of said bridge, and changes a rotational resistance with magneto-rheological fluid of which viscosity is changed by applied current to a coil;

an A/D converter that converts an analog value obtained from said variable resistor according to a turning angle to a digital value; and a controller that is given a digital signal from said A/D converter, and on a basis of said digital signal, controls the applied current to said magnet brake.

2. The stick device according to claim 1, wherein said magnet brake includes:

a case;

a rotary disk that is connected to the rotary shaft of said bridge in said case;

the coil that is contained in said case; and the magneto-rheological fluid that is enclosed around said rotary disk in said case.

3. The stick device according to claim 1, wherein said controller has a memory that retains an A/D converted value, and performs control so as to compare the digital signal obtained from said A/D converter with the A/D converted value retained in said memory, and when the digital signal and the A/D converted value coincide with each other, increase the applied current to said magnet brake.

4. A radio control transmitter including said stick device according claim 1.

5. A radio control transmitter including said stick device according claim 2.

6. A radio control transmitter including said stick device according claim 3.

* * * * *